United States Patent [19]

Brown et al.

[11] Patent Number: 4,488,719

[45] Date of Patent: Dec. 18, 1984

[54] COLLAPSIBLE EXERCISING APPARATUS

[75] Inventors: Peter L. Brown, Chelmsford; Patrick C. Fitzpatrick; Frederick W. Lloyd, both of Harlow, all of England

[73] Assignee: Bodytone Limited, England

[21] Appl. No.: 475,188

[22] Filed: Mar. 14, 1983

[30] Foreign Application Priority Data

May 25, 1982 [GB] United Kingdom ..... 8215206

[51] Int. Cl.[3] ..... A63B 21/00; A63B 69/06

[52] U.S. Cl. ..... 272/72; 272/130

[58] Field of Search ..... 272/72, 130, 132, 73, 272/144, 145

[56] References Cited

U.S. PATENT DOCUMENTS

| | | | |
|---|---|---|---|
| 1,707,791 | 4/1929 | Anderson | 272/134 X |
| 3,164,150 | 1/1965 | Reid | 272/134 X |
| 3,589,720 | 6/1971 | Agamian | 272/134 X |
| 3,892,404 | 7/1975 | Martucci | 272/79 |

FOREIGN PATENT DOCUMENTS

| | | | |
|---|---|---|---|
| 27224 | of 1909 | United Kingdom | 272/72 |
| 419982 | 11/1934 | United Kingdom | 272/72 |
| 438128 | 11/1935 | United Kingdom . | |
| 1101009 | 1/1968 | United Kingdom . | |
| 1326263 | 8/1973 | United Kingdom . | |

OTHER PUBLICATIONS

Amerec 610 and 660 Rowing Machines, Advertizing Brochure of Amerec Bellevue WA 3/82.

*Primary Examiner*—Richard J. Johnson

*Attorney, Agent, or Firm*—Banner, Birch, McKie & Beckett

[57] ABSTRACT

A rowing-type exerciser having a retractable seat support portion is collapsible for compact storage.

9 Claims, 2 Drawing Figures

COLLAPSIBLE EXERCISING APPARATUS

BACKGROUND OF THE INVENTION

The invention relates to physical exercising apparatus and, more particularly, to exercising apparatus of the nature of rowing machines. To an increasing extent rowing machines are being used in domestic situations in spite of a disadvantage of known rowing machines that they are bulky and thus awkward to store when not in use.

SUMMARY OF THE INVENTION

It is an object of the invention to provide a rowing machine which can be stored more easily than known rowing machines and which is nevertheless rigid and stable when in its position of use.

According to the invention there is provided a rowing machine comprising a body having a frame including a longitudinal body member, at least one movable handle mounted on the body, means on the body providing resistance to movement of the handle, ground engaging support means for the body, and bracing means for the feet of the user. A longitudinally adjustable extension of the body has a longitudinal extension member slidably engaged with the longitudinal body member, ground engaging means on the extension member, the arrangement being such that the extension member is adjustable relative to the body to increase the effective length thereof. Longitudinal track means is fixed to the extension above the longitudinal extension member, and is slidably supported by the body. A seat is slidable along the track means, and lock means adjustably fixes the relative position of the body and the extension. Preferably, the extension member is received telescopically in a tubular member on the body. A preferred arrangement comprises a support on the body on which the bracing means and the sliding seat track means are mounted, the tubular member forming part of the support. The support may be detachably secured to the body and the body may comprise a rectangular frame.

BRIEF DESCRIPTION OF THE DRAWINGS

The invention is diagrammatically illustrated, by way of example, in the accompanying drawings in which.

DETAILED DESCRIPTION

Figure 1:
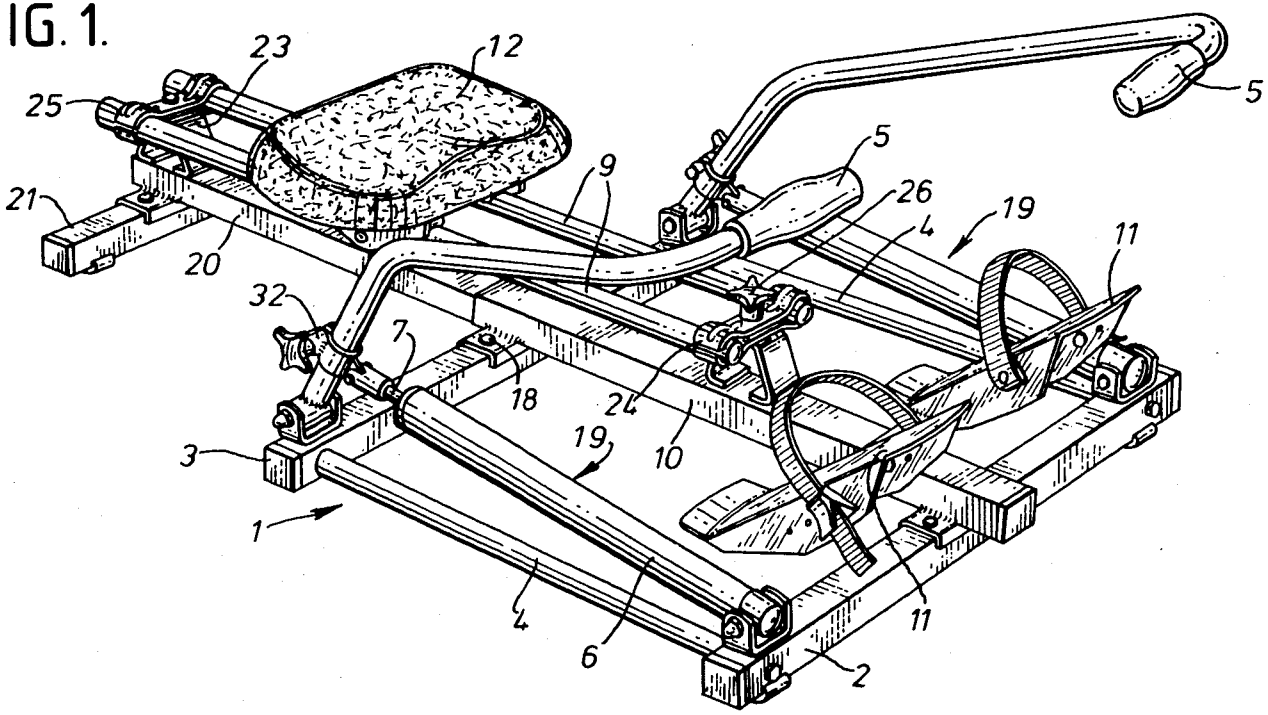
FIG. 1 is a perspective view of a rowing machine in its normal operative position.

In the drawings a rowing machine includes a body which comprises a generally rectangular framework 1 having a pair of square-section bars 2 and 3 respectively interconnected near their ends by a pair of round-section bars 4. A pair of levers formed at their free ends with handles 5 are pivotally mounted on the bar 3 near to the opposite ends thereof and the levers are connected to the piston rods 7 of a pair of hydraulic dampers 19, the cylinders of which are pivotally mounted on the bar 2 near to the opposite ends thereof. The connection between the levers and the piston rods are by means of manually adjustable clamps 32 and thus the position at which the piston rod engages the lever can be varied to alter the effort required to move the handles.

Figure 2:
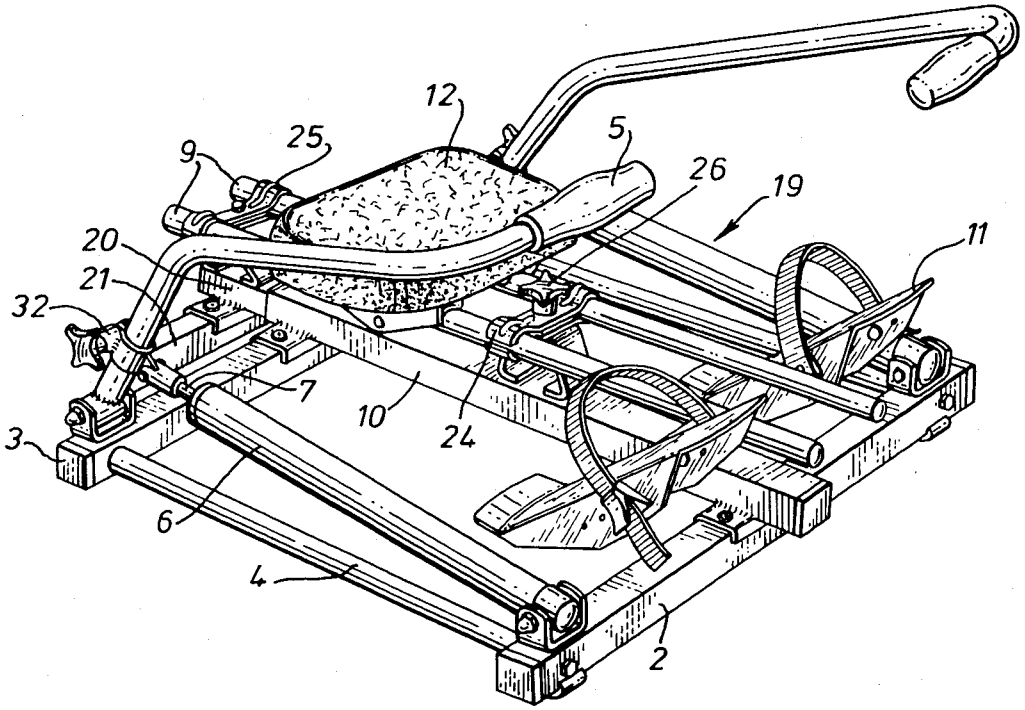
FIG. 2 is a perspective view similar to that of FIG. 1 but showing the rowing machine collapsed for storage.

A square-sectioned tubular main-beam 10 is mounted centrally on the bars 2 and 3 by means of bolts 18. The tubular main beam 10 telescopically receives a square-sectioned extension beam 20, the free end of which carries a ground engaging foot 21. A pedestal 22 is secured on the upper surface of the main beam 10 and a corresponding pedestal 23 is secured on the upper surface of the extension beam 20 at its free end. The pedestals 22 and 23 are formed with respective clamps 24 and 25 which carry a parallel pair of rails 9 for a sliding seat 12. The distance by which the extension beam 20 projects from the main beam 10 can be altered from the fully extended position shown in FIG. 1 to a fully retracted storage position shown in FIG. 2 by releasing the clamp 24 by means of a knob 26 so that the rails 9 can be slid relaive to the clamp 24. For storage purposes the handles 5 would normally be moved from the position shown in FIG. 2 to a position in which they lie close to frame 1.

Also mounted on the beam 10 is a crosspiece (not shown) which carries a pair of footrests 11.

It is to be understood that the above described apparatus is but one example of the invention. It will be apparent to one of ordinary skill that modifications and changes may be made in the structure of the invention without departing from the true spirit and scope of the invention, which is defined by the appended claims.

We claim:

1. A rowing machine comprising:

a body having a frame which includes a longitudinal body member, ground engaging means for supporting the body, and foot bracing means for bracing the feet of a user;

at least one movable handle mounted on the body;

resistance means on the body providing resistance to movement of said handle;

an extension attached to the body and longitudinally adjustable relative thereto, said extension having a longitudinal extension member slidably engaged with said longitudinal body member, ground engaging means for supporting the extension, and longitudinal track means fixed to said extension above said longitudinal extension member;

sliding support means carried by the body for slidably supporting said track means;

lock means for adjustably fixing the longitudinal position of the extension relative to the body, and a seat slidable along said track means.

2. A rowing machine according to claim 1 wherein said lock means is carried by the body and adjustably lockingly engages said track means.

3. A rowing machine according to claim 2 wherein said sliding support means and said lock means comprise a clamping support for slidably supporting and adjustably clamping said track means.

4. A rowing machine according to the claim 3 wherein said clamping support is mounted on said longitudinal body member.

5. A rowing machine according to claim 4 wherein said foot bracing means is mounted on said longitudinal body member.

6. A rowing machine according to claim 5 wherein said longitudinal body member and said longitudinal extension member are telescopingly engaged.

7. A rowing machine according to claim 1 wherein said sliding support means is mounted on said longitudinal body member.

8. A rowing machine according to claim 7 wherein said foot bracing means is mounted on said longitudinal body member.

9. A rowing machine according to claim 8 wherein said longitudinal body member and said longitudinal extension member are telescopingly engaged.

* * * * *